US007140652B2

(12) United States Patent
Johnson et al.

(10) Patent No.: US 7,140,652 B2
(45) Date of Patent: Nov. 28, 2006

(54) DOOR LATCH STRIKER

(75) Inventors: Lawrence W. Johnson, Taylor, MI (US); Michael F. Jeroue, Oakland, MI (US)

(73) Assignee: Illinois Tool Works Inc, Glenview, IL (US)

( * ) Notice: Subject to any disclaimer, the term of this patent is extended or adjusted under 35 U.S.C. 154(b) by 85 days.

(21) Appl. No.: 11/002,506

(22) Filed: Dec. 2, 2004

(65) Prior Publication Data

US 2005/0218669 A1 Oct. 6, 2005

Related U.S. Application Data

(60) Provisional application No. 60/558,696, filed on Apr. 1, 2004.

(51) Int. Cl.
*E05B 15/02* (2006.01)
*E05C 3/06* (2006.01)

(52) U.S. Cl. ..... 292/340; 292/341.11; 292/341.12; 292/341.14; 292/DIG. 57; 292/DIG. 64

(58) Field of Classification Search ..... 292/340, 292/341.11, 341.12, 341.14, DIG. 57, DIG. 64
See application file for complete search history.

(56) References Cited

U.S. PATENT DOCUMENTS 2,151,284 A * 3/1939 Tinnerman ..... 292/17
2,723,151 A * 11/1955 Seyforth ..... 292/340
3,680,902 A * 8/1972 Slattery ..... 292/341.14
4,834,435 A * 5/1989 Kleefeldt ..... 292/340
4,883,298 A * 11/1989 Kleefeldt ..... 292/341.12
4,896,908 A * 1/1990 Kleefeldt ..... 292/216
4,911,488 A * 3/1990 Brackmann et al. ..... 292/216
4,998,759 A * 3/1991 Peterson et al. ..... 292/340
5,209,532 A * 5/1993 Nakamura et al. ..... 292/216
5,316,354 A 5/1994 Arabia, Jr. et al. ..... 292/340
5,494,208 A * 2/1996 Granger ..... 228/173.6
5,494,324 A * 2/1996 Kleefeldt ..... 292/340
5,707,092 A 1/1998 Van Slembrouck et al. ..... 292/341.19
6,073,980 A * 6/2000 Arabia et al. ..... 292/340
6,095,576 A 8/2000 Burton
6,095,577 A * 8/2000 Nolzen ..... 292/340
6,106,037 A 8/2000 Burton
6,108,894 A * 8/2000 Mizuki et al. ..... 29/509
6,267,421 B1 7/2001 Burton ..... 292/340
6,273,480 B1 8/2001 Burton
6,672,634 B1 1/2004 Burton ..... 292/340
6,692,046 B1 * 2/2004 Paskonis ..... 292/340
6,698,080 B1 * 3/2004 Sawajiri et al. ..... 29/509
6,883,842 B1 * 4/2005 Paskonis ..... 292/340
2002/0047280 A1 4/2002 Burton ..... 292/340

* cited by examiner

*Primary Examiner*—Brian E. Glessner
*Assistant Examiner*—Carlos Lugo
(74) *Attorney, Agent, or Firm*—Mark W. Croll; Paul F. Donovan

(57) ABSTRACT

A latch striker includes a base and an arm having a segment extending over the base in spaced relation thereto. Cylinder segments project toward each other from the base and arm and are axially aligned and secured with respect to each other.

20 Claims, 1 Drawing Sheet

DOOR LATCH STRIKER

CROSS-REFERENCE TO RELATED APPLICATIONS

The present regular United States Patent Application claims the benefits of U.S. Provisional Application Ser. No. 60/558,696 filed on Apr. 1, 2004.

FIELD OF THE INVENTION

The present invention generally relates to vehicle door closure system latches and, more specifically, to door striker plates used on vehicle latch systems.

BACKGROUND OF THE INVENTION

Vehicle latch systems must be strong and secure to prevent unintended opening of vehicle doors during accidents and other unforeseen events. A known design for a vehicle latch system includes a striker mounted on the doorframe and a releasable latch mechanism on the door configured to engage the striker. The striker includes a bracket secured to the vehicle and a steel post supported by the bracket. The steel post is engaged by the latch mechanism when the door is closed.

Securing the post to the bracket can be both difficult and time consuming. Multiple assembly steps can be required to secure the steel post to the bracket, which may be by welding or other material joining process, threaded engagement between the steel post and a threaded boss on the bracket or securing the post with bolts, nuts or other mechanical fasteners.

Further difficulties can be encountered while securing the assembled striker in the automobile. It is known to provide holes in the bracket by which the bracket is secured with bolts to a frame component of the automobile. The bolts are necessarily short and can be lost or dropped easily during the installation process. The installer must position the bracket in the proper place, insert a bolt or other fastener, and operate an appropriate tool to tighten the fastener.

Consequently, a relatively simple part such as the door striker can be relatively expensive to manufacture and costly to install.

What is needed in the art is a vehicle striker that is sturdy and lightweight, easy and economical to manufacture and simple to install.

SUMMARY OF THE INVENTION

The present invention provides a one-piece drawn component having a base and an arm, which cylinder components formed in both the base and arm and aligned with each other. The aligned cylinder components are secured with respect to each other to form a column to be engaged by the latch mechanism of a vehicle door.

In one aspect thereof, the present invention provides a door striker with a base, an arm having a first arm segment connected to the base and a second arm segment extending from the first arm segment over the base in spaced relation to the base. A column is formed from a first cylinder segment integral with the base and a second cylinder segment integral with the second arm segment. The first and second cylinder segments are aligned axially one with another. The axially aligned relationship between the first cylinder segment and the second cylinder segment is fixed is position.

In another aspect thereof, the present invention provides a door striker with a monolithic body having a base and an arm. A segment of the arm extends over the base in spaced relation thereto. A column is formed by axially aligned cylinder segments projecting toward each other from the base and the arm. The axially aligned relationship between the cylinder segments is fixed.

In still another aspect thereof, the present invention provides a process for forming a door striker, with steps of shaping a one-piece monolithic body of material to provide a base and an arm, with a segment of the arm extending over the base in spaced relation thereto. Forming a first cylinder segment in the base projecting from the base toward the arm. Forming a second cylinder segment projecting from the arm toward the base. Aligning the first and second cylinder segments axially one with respect to the other, and securing the axially aligned positions of the first and second cylinder segments with respect to each other.

An advantage of the present invention is providing a vehicle striker that is strong and lightweight.

Another advantage of the present invention is providing a vehicle latch striker that is easy to manufacture and that facilitates installation in the automobile.

Other features and advantages of the invention will become apparent to those skilled in the art upon review of the following detailed description, claims and drawings in which like numerals are used to designate like features.

Figure 1:
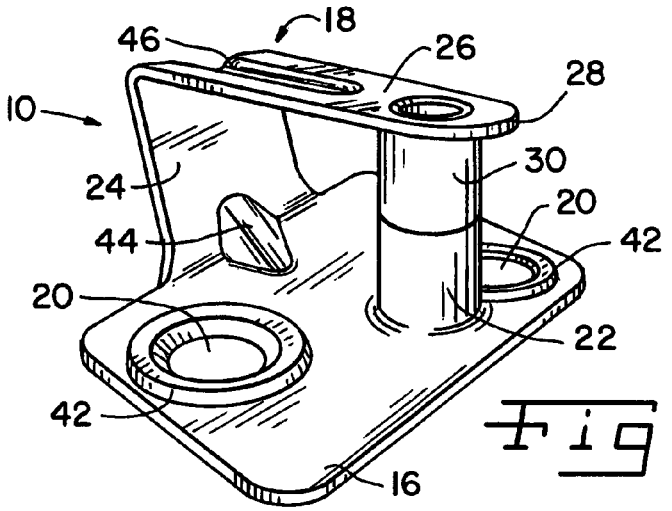
FIG. 1 is a perspective view of a vehicle latch striker in accordance with the present invention.
Figure 2:
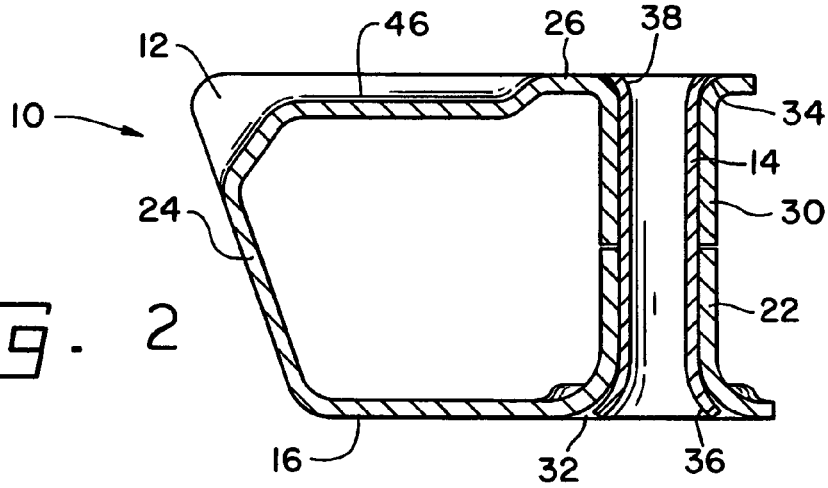
FIG. 2 is a cross-sectional view of the striker shown in FIG. 1.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use herein of "including", "comprising" and variations thereof is meant to encompass the items listed thereafter and equivalents thereof, as well as additional items and equivalents thereof.

DETAILED DESCRIPTION OF THE PREFERRED EMBODIMENT

Referring now more specifically to the drawings and to FIG. 1 in particular, numeral 10 designates a latch system component or striker in accordance with the present invention. A striker 10 embodying the present invention can be used in a variety of latch systems, and the general configuration, appearance and structure, including the size thereof, can vary from one latch system to another, as required.

As best seen in FIG. 1, striker 10 includes a monolithic body 12 and an insert 14. Body 12 is formed from a single piece of material by a metal drawing process, stamping or the like. High-strength spring steel or other suitable material that offers both lightweight and high-strength characteristics can be used. Insert 14 is similarly constructed of steel or other high strength material.

Body 12 is a monolithic, one-piece structure including a base 16 and an arm 18. Base 16 provides the platform by which striker 10 is secured in the vehicle and defines one or more holes 20 for receiving bolts or other fasteners for securing striker 10 to the vehicle. Base 16 further defines a protuberance 22 in the form of a cylindrical protuberance 22 projecting outwardly from base 16.

Arm 18 includes a first arm segment 24 connected to base 16 and extending away therefrom. A second arm segment 26 extends from first arm segment 24 over base 16, in spaced relation thereto. Near a distal end 28 of second arm segment 26, a cylindrical projection 30 is formed of a diameter similar to that of cylindrical protuberance 22.

Cylindrical protuberance 22 and cylindrical projection 30 are axially aligned one with another and thereby form first and second cylindrical segments of a cylindrical column formed between base 16 and arm 18.

During the formation of body 12, a funnel-like entrance 32 is formed in base 16 leading into cylindrical protuberance 22. A similar funnel-like entrance 34 is formed in second arm segment 26 leading into cylindrical projection 30.

Insert 14 is disposed in the axially aligned cylindrical protuberance 22 and cylindrical projection 30, and extends from entrance 32 to entrance 34. Insert 14 is a cylindrical body having an outside diameter selected to fit snugly within the opening formed by aligned cylindrical protuberance 22 and cylindrical projection 30. Opposite ends of insert 14 are flared or expanded outwardly to form a first outwardly flared end 36 in entrance 32 and a second outwardly flared end 38 within entrance 34. By expanding or flaring ends 36 and 38, insert 14 is secured within the axially aligned cylindrical protuberance 22 and cylindrical projection 30. Insert 14 rigidifies and strengthens the column formed between base 16 and second arm segment 26. The column thus formed engages the second component of a latch system provided on the vehicle door or the like.

Although shown and described as a hollow cylinder, insert 14 can be a solid pin, with ends thereof mushroomed or expanded for securing within axially aligned cylindrical protuberance 22 and cylindrical projection 30.

A striker 10 in accordance with the present invention can be assembled without an insert 14. Axially aligned cylindrical protuberance 22 and cylindrical projection 30 can be fastened one to another such as by welding or other material bonding technique. Further, axially aligned cylindrical protuberance 22 and cylindrical projection 30 can be mechanically connected by interlocking end structures, a press-fit connection, snap-fit connection or chemical adherence using adhesive, plastic coatings and the like. For example, axially aligned cylindrical protuberance 22 and cylindrical projection 30 can be filled with molten material, such as plastic. The end for end abutment of cylindrical protuberance 22 and cylindrical projection 30 can be maintained by these and other structures and relationships.

Figure 3:
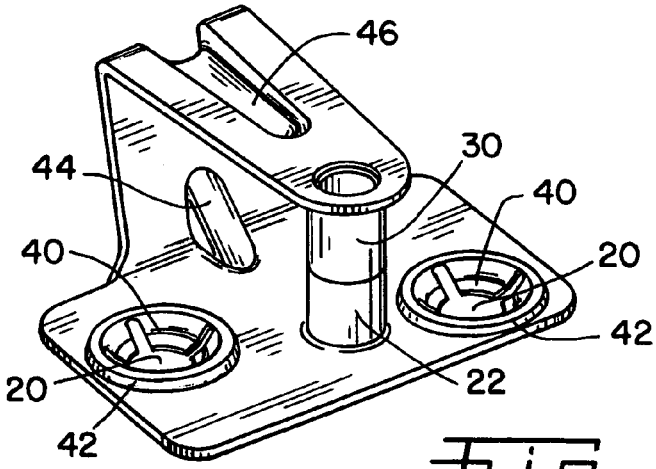
FIG. 3 is a perspective view of a modified form of a striker in accordance with the present invention.

FIG. 3 illustrates an embodiment of the present invention in which bolt holes 20 are provided with a plurality of inwardly projecting fingers 40. Fingers 40 are resilient projections configured and arranged one with respect to another to physically engage a bolt or other fastener placed within bolt holes 20. Fingers 40 can be configured to threadedly engage threads of a bolt or other fastener inserted therein or to deflect and compressively engage a fastener positioned therein. Fingers 40 facilitate pre-assembly of striker 10 with appropriate fasteners and the retention of the fasteners in proper position for securing striker 10 within the vehicle. Thus, installation of striker 10 is facilitated.

Further, fingers 40 directed angularly inwardly and away from the side from which the fasteners are installed can extend beyond the surface of base 15 opposite the surface from which protuberance 22 extends. Extended in such manner, fingers 40 can be used to center hole 20 relative to an opening in a panel or frame member against which striker 10 is fastened.

A boss 42 formed around hole 20 provides a countersink depression for receiving and centering a head of a fastener. Boss 42, together with fingers 40, ensure facilitates the proper alignment of all components as the fastener is tightened.

Those skilled in the art will understand readily that in drawing, stamping or otherwise forming body 12 a variety of gussets 44, beads or channels 46 and the like can be formed to strengthen and rigidify the final structure of body 12.

Although shown and described as a cylindrical, protuberance 22 and projection 30 can be of other cross-sectional shapes, and insert 14, if used, can be of a similar cross-sectional shape to fit within the axially aligned protuberance 22 and projection 30. For example, each can be of rectangular or other cross-sectional shapes.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A door striker comprising:

a base;

an arm having a first arm segment connected to said base and extending away from said base, and a second arm segment extending from said first arm segment over said base in spaced relation to said base;

a column formed from a first cylinder segment integral with said base and a second cylinder segment integral with said second arm segment, such that said base, said arm and said column are formed from a single piece of material said first and second cylinder segments substantially aligned axially one with another; and means fixing the axially aligned relationship between said first cylinder segment and said second cylinder segment.

2. The door striker of claim 1, said means comprising an insert extending from said first cylinder segment to said second cylinder segment.

3. A door striker comprising:

a base;

an arm having a first arm segment connected to said base and extending away from said base, and a second arm segment extending from said first arm segment over said base in spaced relation to said base;

a column formed from a first cylinder segment integral with said base and a second cylinder segment integral with said second arm segment, said first and second cylinder segments substantially aligned axially one with another; and means fixing the axially aligned relationship between said first cylinder segment and said second cylinder segment, said means comprising an insert extending from said first cylinder segment to said second cylinder segment;

said first and second cylinder segments having funnel-like entrances thereto, and said insert being flared outwardly in said funnel-like entrances.

4. The door striker of claim 3, said insert being a cylinder.

5. The door striker of claim 1, said base defining anchor holes.

6. The door striker of claim 5, said anchor holes having inwardly projecting fingers.

7. The door striker of claim 1, said second arm segment being substantially parallel to said base.

8. A door striker comprising:

a monlolithic body having a base and an arm, with a segment of said arm extending over said base in spaced relation thereto;

a column formed by axially aligned cylinder segments projecting from said base and said arm segment toward one another, such that said base said arm and said column are formed from a single piece of material; and means fixing the axially aligned relationship between said cylinder segments.

9. The door striker of claim 8, said means comprising an insert encoding bctween and secured within said cylinder segments.

10. The door striker of claim 9, said insert being hollow.

11. The door striker of claim 10, said insert having opposite ends thereof flared against said arm segment and said base.

12. The door striker of claim 8, said base defining a hole for receiving a fastener.

13. The door striker of claim 12, said hole including inwardly extending fingers for a fastener within said hole.

14. The door striker of claim 12, said base defining a boss around said hole.

15. A process for forming a door striker, comprising the steps:

shaping a one-piece monolithic body of material provide a base and an arm, with a segment of the arm extending over the base in spaced relation thereto;

forming a first cylinder segment in the base projecting from the base toward the arm;

forming a second cylinder segment projecting from the arm toward the base;

aligning the first and second cylinder segments axially one with respect to the other; and securing the axially aligned positions of the first and second cylinder segments with respect to each other.

16. The process of claim 15, including inserting a body into the aligned first and second cylinder segments.

17. The process of claim 16, including flaring ends of the body to secure the body within the first and second cylinder segments.

18. The process of claim 15, including forming holes in the base for receiving fasteners.

19. The process of claim 18, including creating fingers at the perimeter of the hole for engaging a fasten inserted in the hole.

20. The process of claim 15, including forming the body by a metal drawing process.

* * * * *